US007078851B2

(12) United States Patent
Suzuki et al.

(10) Patent No.: US 7,078,851 B2
(45) Date of Patent: Jul. 18, 2006

(54) CATHODE RAY TUBE

(75) Inventors: Yukio Suzuki, Mobara (JP); Sachio Koizumi, Mobara (JP); Toshifumi Komiya, Mobara (JP)

(73) Assignee: Hitachi Displays, Ltd., Chiba-ken (JP)

( * ) Notice: Subject to any disclaimer, the term of this patent is extended or adjusted under 35 U.S.C. 154(b) by 0 days.

(21) Appl. No.: 10/793,438

(22) Filed: Mar. 4, 2004

(65) Prior Publication Data

US 2004/0183423 A1 Sep. 23, 2004

(30) Foreign Application Priority Data

Mar. 19, 2003 (JP) ..... 2003-076028

(51) Int. Cl.
*H01J 29/04* (2006.01)

(52) U.S. Cl. ..... 313/270; 313/446; 313/346 DC

(58) Field of Classification Search ..... 313/346 DC, 313/446, 270

See application file for complete search history.

(56) References Cited

U.S. PATENT DOCUMENTS 6,016,026 A * 1/2000 Lee ..... 313/346 R
6,242,852 B1 * 6/2001 Nakamura et al. ..... 313/270
6,734,609 B1 * 5/2004 Weon ..... 313/310
2002/0084740 A1 * 7/2002 Nakamura et al. ..... 313/446

FOREIGN PATENT DOCUMENTS

CN 1238547 12/1999
CN 1368750 11/2002

* cited by examiner

*Primary Examiner*—Ashok Patel
(74) *Attorney, Agent, or Firm*—Milbank, Tweed, Hadley & McCloy LLP

(57) ABSTRACT

The indirectly heated cathode structure includes a base metal having a thermal electron emitting material layer, a cylindrical sleeve holding the base metal at one end portion thereof and housing a heating heater in the inside thereof, an support having a large-diameter portion and g a small-diameter portion, and a cathode disc having a large-diameter portion at the leg-portion-side of the heating heater and having a small-diameter portion at the heater-main-portion side of the heating heater, wherein an outer surface of another end portion of the sleeve and an inner surface of the small-diameter portion of the support are fixed to each other, and an outer surface of the large-diameter portion of the support and an inner surface of the small-diameter portion of the cathode disc are fixed to each other.

3 Claims, 5 Drawing Sheets

CATHODE RAY TUBE

BACKGROUND OF THE INVENTION

1. Field of the Invention

The present invention relates to a cathode ray tube having an electron gun which is provided with an indirectly heated cathode structures and more particularly to the electrode structure of the indirectly heated cathode structure.

2. Description of the Related Art

A cathode ray tube used in a television receiver set, a display tube or the like has the high-definition image reproducibility and hence, the cathode ray tube has been popularly used as a display means for various information processing equipments.

This type of cathode ray tube is formed of an evacuated envelope which includes a panel portion forming a phosphor screen by applying phosphor to an inner surface thereof, a neck portion housing an electron gun which has a plurality of electrodes and focuses and accelerates electron beams generated by an electron beam generating portion constituted of an indirectly heated cathode structure, a control electrode and an acceleration electrode and irradiates the electron beams to the phosphor screen, and a funnel portion connecting the panel portion and the neck portion and exteriorly mounting a deflection yoke which scans the electron beams emitted from the electron gun on the phosphor screen thereon.

FIG. 5 is a cross-sectional view for explaining the constitution of the indirectly heated cathode structure. In the drawing, the indirectly heated cathode structure 21 includes a bead support 22, an eyelet 23, a heater support 24, a heater 25, a substrate metal 27 which holds an electron emitting material layer 26, a cathode support sleeve 28 and a cathode disc 29.

The indirectly heated cathode structure 21 is fixed to a multiform glass 20 by the eyelet 23 and the bead support 22. Further, the heater 25 housed in the inside of the cathode support sleeve 28 has end portions (leg portions) thereof fixed to the heater support 24 by welding.

FIG. 6A, 6B are an explanatory view showing the constitution of the heater 25 shown in FIG. 5, wherein FIG. 6A is a side view of the heater 25 and FIG. 6B is an enlarged cross-sectional view of a portion A in FIG. 6A. In these drawings, the heater 25 is formed by applying an alumina insulation film 32 to a tungsten core 31 which is formed by spirally winding a coil, by applying tungsten fine powder 33 to a surface of the alumina insulation film 32, and by blackening the tungsten fine powder 33. This blackening treatment is performed for enhancing the efficiency of the irradiation of radiation heat from the heater 25 thus lowering a temperature of a heater 25 whereby the reliability is enhanced.

In FIG. 6A, numeral 34 indicates a heater leg portion which has a triplicate winding structure of the tungsten core 31 shown in FIG. 6B, numeral 35 indicates a duplicate spiral forming portion (a heater main portion), numeral 36 indicates a surface blackening treatment portion using the tungsten fine powder 33 shown in FIG. 6B, numeral 37 indicates an alumina coating portion, numeral 38 indicates an alumina non-coating portion, and numeral 39 indicates a molybdenum wire dissolved mark (a hollow portion). This type of indirectly heated cathode structure is disclosed in following patent literature 2 and patent literature 3 and the like.

Patent literatures 1 disclose the method for manufacturing the indirect cathode sleeve. A cathode sleeve consist of a bimetal which consist of a Nickel-Chrome alloy at an inside surface of the cathode sleeve and a Nickel alloy at an outside surface of the cathode sleeve Patent literature 1: Japanese Unexamined Patent Publication Hei7(1995)-182965 which corresponds to U.S. Pat. No. 5,569,391.

Patent literature 2: Japanese Unexamined Patent Publication Hei11(1995)-354041 which corresponds to U.S. Pat. No. 6,492,768.

Patent literature 3: Japanese Unexamined Patent Publication 2002-93335 which corresponds to U.S. Pat. No. 6,552,479.

In the indirectly heated cathode structure of the cathode ray tube having such a constitution, with respect to the heating heater, the electric resistance of the leg portion of the heater becomes low due to the triplicate winding structure and hence, a heat value of the leg portion becomes small and the heater power concentrates on the duplicate spiral forming portion whereby the power consumption can be reduced. However, when the multiplex coil winding is merely applied to the heater leg portion, the electric resistance reduction effect is still small and hence, there exists a limit with respect to the reduction of power consumption of the heater.

Further, there has been also known a related art which proposes the constitution in which the power consumption is realized by blackening an inner wall surface of a cathode sleeve of an indirectly heated cathode structure. However, there has been known no related art which discloses or takes into an account the constitution which can reduce the power consumption positively thus realizing the low power consumption while enhancing the various electrical characteristics by improving the electrode structure of the indirectly heated cathode structure and the structure of the heated heater.

Further, recently, from a viewpoint of power saving, the low power consumption has been further strongly requested. This demand for the low power consumption constitutes one of contemporary critical issues and the significance thereof is steadily increasing. To explain the current actual power consumption state of the cathode ray tube, the power consumption of a monitor set is approximately 100W, wherein the power consumption of the indirectly heated cathode amounts to 2 to 4% of the power consumption of the monitor set.

Further, with respect to a heating heater of three-electron-gun type which is generally adopted by the cathode ray tube or the like, the heater having the specification in which the rating of the heater is 6.3V–300 mA (one electron gun: 0.63 W per one heater) is popularly used and hence, the sufficient power saving has not been realized.

Accordingly, the present invention has been made to solve the above-mentioned drawbacks of the related art and it is an object of the present invention to provide a cathode ray tube having an electron gun provided with an indirectly heated cathode structure which can reduce the power consumption of a heater by decreasing the temperature elevation of respective electrodes which constitute the indirectly heated cathode structure.

SUMMARY OF THE INVENTION

A cathode ray tube including a vacuum envelope comprising: a panel portion having a phosphor screen to which phosphor is applied on an inner surface thereof; a neck portion housing an electron gun which is constituted of an electron beam generating portion which includes an indirectly heated cathode structure, a control electrode and an acceleration electrode, a focusing electrode and an anode electrode and has a main lens portion which focuses and accelerates electron beams; and a funnel portion connecting the panel portion and the neck portion.

The indirectly heated cathode structure of a cathode ray tube according to the present invention includes a base metal having a thermal electron emitting material layer, a cylindrical sleeve holding the base metal at one end portion thereof and housing a heating heater in the inside thereof, a cylindrical support having a large-diameter portion at a heater-main-portion side of the heater, having a small-diameter portion at a leg-portion-side of the heater and supporting the sleeve, and a cylindrical cathode disc having a large-diameter portion at the leg-portion-side of the heater and having a small-diameter portion at the heater-main-portion side of the heater, wherein an outer surface of another end portion of the sleeve and an inner surface of the small-diameter portion of the support are fixed to each other, and an outer surface of the large-diameter portion of the support and an inner surface of the small-diameter portion of the cathode disc are fixed to each other, whereby a heat conduction distance from an outer wall surface of the sleeve to an end portion of the large-diameter portion of the cathode disc by way of the support is elongated.

It is preferable to set a plate thickness of the sleeve to a value equal to or more than 15 μm and equal to or less than 20 μm. Further, it is desirable that the heating heater uses a tungsten wire having a wire diameter of 22 μm to 29 μm or less, and the number of multiplex winding of a leg portion of the heating heater is larger than the number of multiplex winding of the heater main portion of the heating heater.

In this specification, the present invention is not limited to the above-mentioned constitution and it is needless to say that various modifications are conceivable without departing from the technical concept of the present invention described in claims.

DESCRIPTION OF THE PREFERRED EMBODIMENTS

Preferred embodiments of the present invention are explained in detail in conjunction with drawings showing the embodiments.

Figure 1:
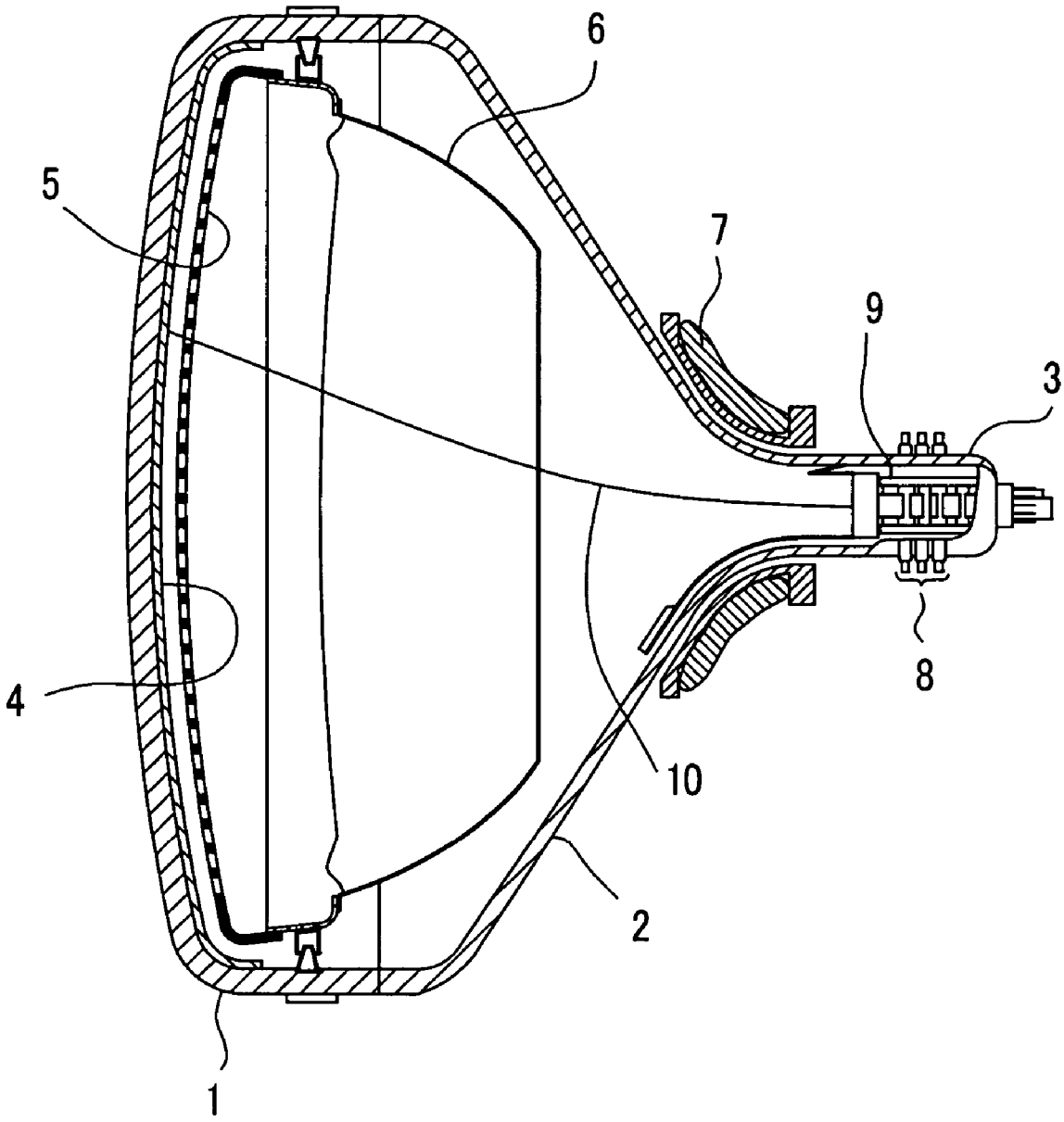
FIG. 1 is a schematic cross-sectional view showing the schematic constitution of a shadow-mask type color cathode ray tube for explaining one embodiment of a cathode ray tube according to the present invention.

FIG. 1 is a schematic cross-sectional view showing the schematic constitution of a shadow-mask type color cathode ray tube for explaining one embodiment of a cathode ray tube according to the present invention. In the drawing, numeral 1 indicates a panel portion, numeral 2 indicates a funnel portion, numeral 3 indicates a neck portion, numeral 4 indicates a phosphor screen which is formed by applying a phosphor to an inner surface of the panel portion 1, numeral 5 indicates a shadow mask which constitutes a color selection electrode, numeral 6 indicates a magnetic shield which blocks an outer magnetic field (earth magnetism), numeral 7 indicates a deflection yoke, numeral 8 indicates an outer magnetism correction device, numeral 9 indicates an electron gun provided with an indirectly heated cathode which irradiates three electron beams, and numeral 10 indicates an electron beam representing one of three electron beams.

In such a constitution, three electron beams 10 irradiated from the electron gun 9 are modulated in response to a video signal outputted from an external signal processing circuit not shown in the drawing and are irradiated to the phosphor screen 4. The electron beams 10 are scanned two-dimensionally on the phosphor screen 4 when the electron beams 10 are made to pass through horizontal and vertical deflection magnetic fields generated by the deflection yoke 7 exteriorly mounted on a transition area between the neck portion 3 and the funnel portion 2. The shadow mask 5 selects respective three electron beams for respective colors which pass through many apertures formed in the plane of the shadow mask 5 thus reproducing a given image.

Figure 2:
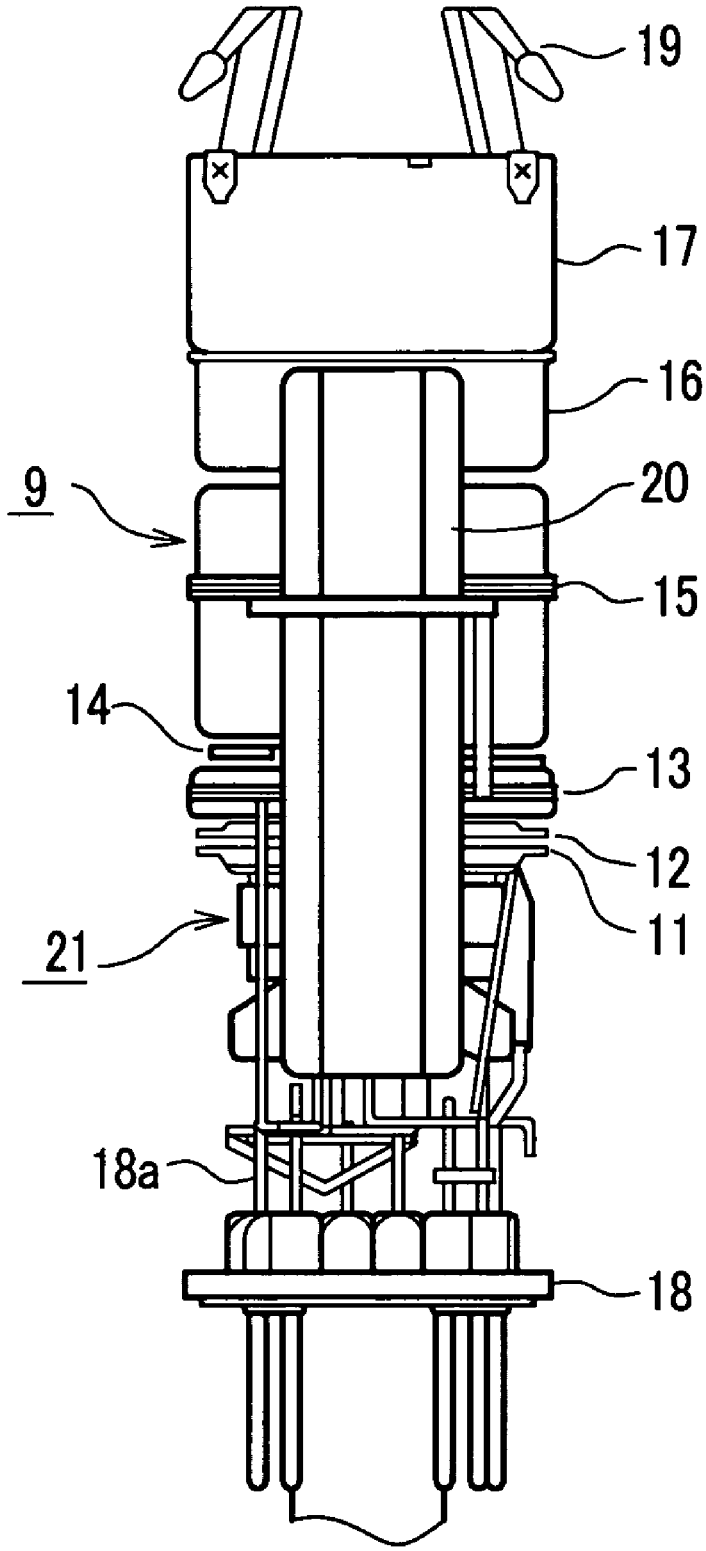
FIG. 2 is a side view showing the constitution of an electron gun used in the color cathode ray tube shown in FIG. 1.

FIG. 2 is a side view for explaining the constitution of the electron gun used in the color cathode ray tube shown in FIG. 1. In the drawing, the electron gun 9 is constituted as follows. A control electrode (a first grid electrode: G1) 11, an acceleration electrode (a second grid electrode: G2) 12, a third grid electrode (G3) 13, a fourth grid electrode (G4) 14, a focusing electrode (a fifth grid electrode: G5) 15, an anode (a sixth grid electrode: G6) 16 and a shield cup 17 are arranged in a row at a given interval and with a given positional relationship in the tube axis direction. These components are respectively fixed and supported by a multiform glass 20 and tabs and lead lines which are provided to respective electrodes are welded to stem pins 18*a* mounted on a stem 18 in an erected manner.

Further, in the electron gun 9, an indirectly heated cathode structure 21 is arranged close to the stem 18 side of the control electrode 11 and a heater which heats the electron emitting portion is incorporated in the indirectly heated cathode structure 21. Here, numeral 19 indicates a bulb spacer contact. The bulb spacer contact 19 has a function of aligning the center axis of the electron gun with the tube axis by being brought into resilient contact with an inner wall surface of the neck portion and, at the same time, a function of introducing an anode voltage from an inner conductive film applied to inner wall surfaces of the funnel portion and the neck portion to the electron gun.

Further, the electron beam generating portion is constituted of the control electrode 11, the acceleration electrode 12 and the indirectly heated cathode structure 21. Further, the electrodes 13 to 15 accelerate and focus the electron beams irradiated from the electron beam generating part. Accordingly, the electron beams are focused by a main lens formed between the focusing electrode 15 and the anode 16 and, thereafter, are directed toward the phosphor screen.

Further, the stem 18 is welded to an open end of the neck portion of the vacuum envelope and a signal and a voltage supplied from the external drive circuit are applied to respective electrodes through the stem pins 18*a*. Further, the external magnetism correction device (magnet assembled body) 8 shown in FIG. 1 has a function of correcting the misalignment of the electron beams 10 and the phosphor screen 4 attributed to the axial deviation or the rotary deviation between the electron gun 9 and the panel portion 1, the funnel portion 2 or the shadow mask 5.

Figure 3:
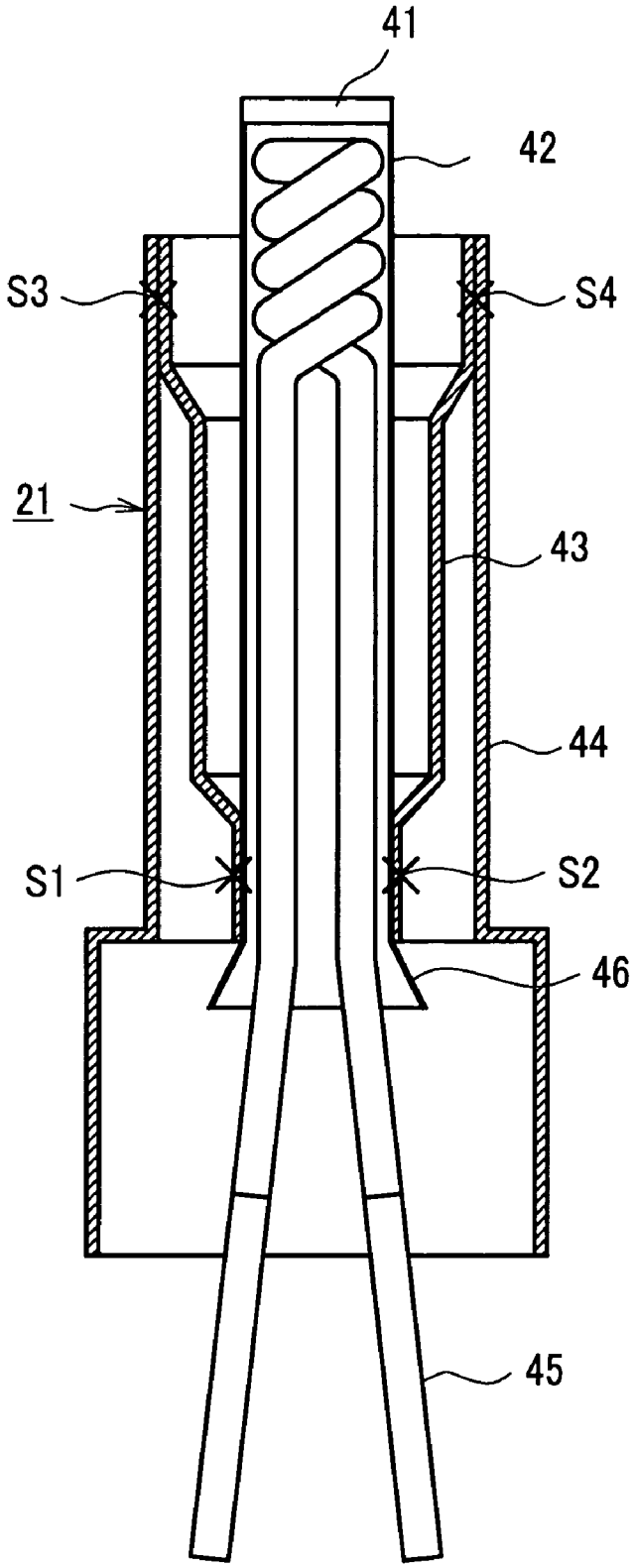
FIG. 3 is an enlarged cross-sectional view showing the constitution of an indirectly heated cathode structure used in the electron gun shown in FIG. 2.

FIG. 3 is an enlarged cross-sectional view for explaining the constitution of the indirectly heated cathode structure used in the electron gun shown in FIG. 2. In FIG. 3, numeral 41 indicates a base metal which forms a thermal electron emitting material layer on a surface of a top portion thereof, numeral 42 indicates a cylindrical sleeve for holding the base metal 41 at an end portion thereof, numeral 43 indicates a cylindrical difference-diameter support for supporting the sleeve 42, numeral 44 indicates a cylindrical cathode disc for fixing the support 43, and numeral 45 indicates a heating heater which is housed in the inside of the sleeve 42 to heat the base metal 41.

In such a constitution, the thermal electron emitting material layer held on a surface of a top portion of the base metal 41 starts from alkaline earth ternary carbonate containing barium (Ba) and contains a plurality of alkaline earth metal oxides containing barium expressed by chemical formulae (Ba, Ca, Sr)O obtained by decomposition as main components. The base metal 41 which holds the thermal electron emitting material layer is formed in a cap shape by molding a nickel plate material having a thickness of approximately 0.14 mm and containing trace amounts of a reducing agent such as magnesium (Mg) and silicon (Si) using a press forming method or the like.

Further, the sleeve 42 which mounts the base metal 41 on a phosphor-screen-side end portion thereof (upper side in the drawing) is formed into an approximately cylindrical shape by molding a nickel-chromium (Ni—Cr) alloy material using a press forming method such that the sleeve 42 has an entire length of approximately 7.5 mm, a diameter of approximately 1 mm and a plate thickness of equal to or less than approximately 20 μm. Further, another end portion (down side in the drawing) of the sleeve 42 which is positioned at the stem side is formed such that a flange-like flare portion 46 larger than the above-mentioned phosphor-screen side end portion (one end portion) of the sleeve 42 and having an outer diameter of approximately 1 mm is provided.

Further, the support 43 which supports the sleeve 42 is formed by integrally molding a nickel (Ni) plate material having a favorable thermal conductivity using a press forming method such that a plate thickness becomes approximately 0.015 mm. Further, the sleeve 42 has an irregular shape and is integrally formed of a large-diameter portion, an intermediate-diameter portion and a small-diameter portion by sequentially and gradually narrowing an outer diameter of the sleeve 43 along the direction of parallel to the tube axis in order of one end portion (phosphor screen side), a center portion and another end portion (stem side).

Further, with respect to the sleeve 42, an outer surface of an end portion of a cylindrical portion close to another end portion is joined to an inner surface of the small-diameter portion of the support 43 and the joining portion is spot-welded and is fixed at welding points S1, S2 using a laser welding method, for example, so that the sleeve 42 is supported and fixed to the support 43. Here, although only two welding points S1, S2 are shown in the drawing and other welding points are not shown in the drawing, at least three welding points are necessary in the circumferential direction to support and fix the respective electrodes on the center axis in a stable manner.

Further, the cathode disc 44 which supports and fixes the sleeve 42 and the support 43 are formed by integrally molding a nickel (Ni) plate material having the favorable thermal conductivity by a press forming method or the like. The cathode disc 44 is formed in an irregular shape such that the cathode disc 44 is integrally constituted of a small-diameter portion and a large-diameter portion which differ in the outer diameter along the lengthwise direction between one end portion (phosphor screen side) and another end portion (stem side). Here, the cathode disc 44 is formed such that a wall thickness thereof is relatively larger than a wall thickness of the support 43.

Further, with respect to the support 43, an outer surface of one end portion of the support 43 and an inner surface of the small-diameter portion of the cathode disc 44 are joined to each other and the joining portion is spot-welded and fixed at welding points S3, S4 using a laser welding method, for example, so that the support 43 on which the sleeve 42 is supported and fixed is supported and fixed to the cathode disc 44. Here, although only two welding points S3, S4 are shown in the drawing and other welding points are not shown in the drawing, at least three welding points are necessary in the circumferential direction to support and fix the respective electrodes on the center axis in a stable manner.

A joining portion of an outer surface of another end portion of the sleeve 42 formed with a plate thickness of equal to or less than 20 μm and an inner surface of the small-diameter portion of the support 43 is welded so as to support and fix the sleeve 42 to the support 43. By welding the joining portion of an outer surface of one end portion of the support 43 and an inner surface of the small diameter portion of the cathode disc 44, the support 43 to which the sleeve 42 is supported and fixed is supported and fixed to the cathode disc 44. By connecting the sleeve 42 and the cathode disc 44 by way of the support 43, the heat conduction distance from the outer wall portion of the sleeve 42 to the lower end portion of the cathode disc 44 byway of the support 43 can be elongated. Accordingly, it is possible to prevent leaking of heat from the sleeve 42. As a result, the thermal efficiency is enhanced and hence, the power consumption of the cathode structure 21, particularly the power consumption of the cathode system can be lowered.

The embodiment has been explained with respect to the case in which the plate thickness of the sleeve 42 is set to 20 μm or less. When the plate thickness of the sleeve 42 exceeds 20 μm, this enhances the conductivity of heat generated by the heat generating portion of the heater 45 and hence, the thermal efficiency of the heater is lowered whereby the reduction of power consumption cannot be achieved. On the other hand, when the plate thickness of the sleeve 42 is set to an extremely small value such as approximately several μm, although the reduction of the power consumption can be further enhanced, there arises drawbacks with respect to the mechanical strength, formability and the like. Accordingly, the minimum allowable plate thickness of the sleeve 42 is approximately 15 μm.

Figure 4:
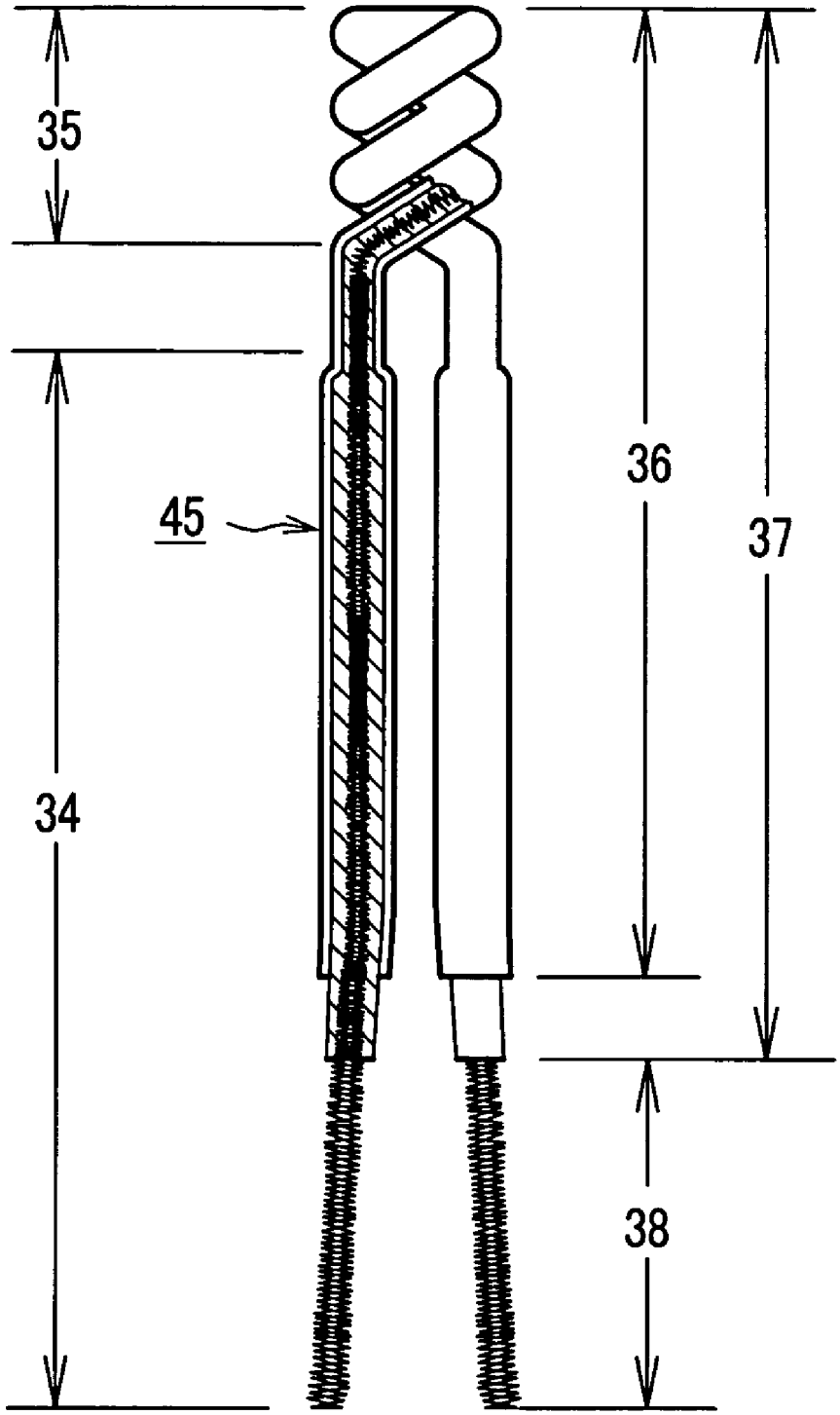
FIG. 4 is a side view with a part in cross section showing the constitution of the heating heater used in the indirectly heated cathode structure shown in FIG. 3.
Figure 6A:
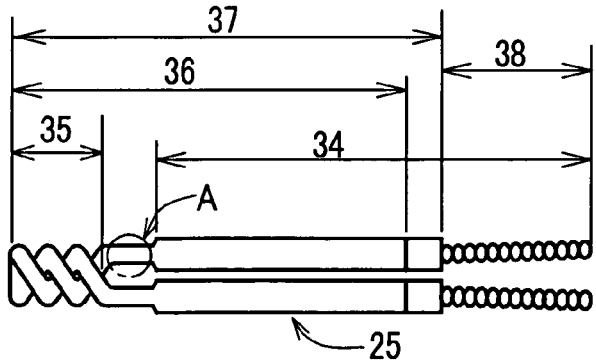
FIG. 6A (Prior Art)
FIG. 6A, 6B are a view for explaining the structure of a heating heater.
Figure 6B:
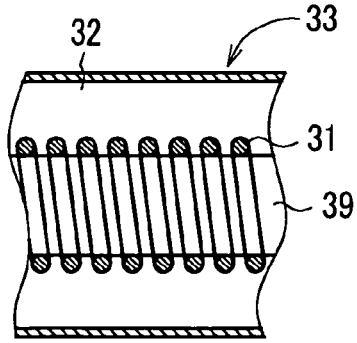
FIG. 6B (Prior Art)

FIG. 4 is an appearance side view for explaining the constitution of the heater 45 used in the indirectly heated cathode structure shown in FIG. 3. The basic structure of the heater 45 lies in that an alumina insulation film is applied to a tungsten core which is spirally formed into a coil wiring and, thereafter, the blackening treatment is applied to the coil wiring by coating a surface of the alumina insulation film with tungsten fine powder, as well as FIG. 6B.

Figure 5:
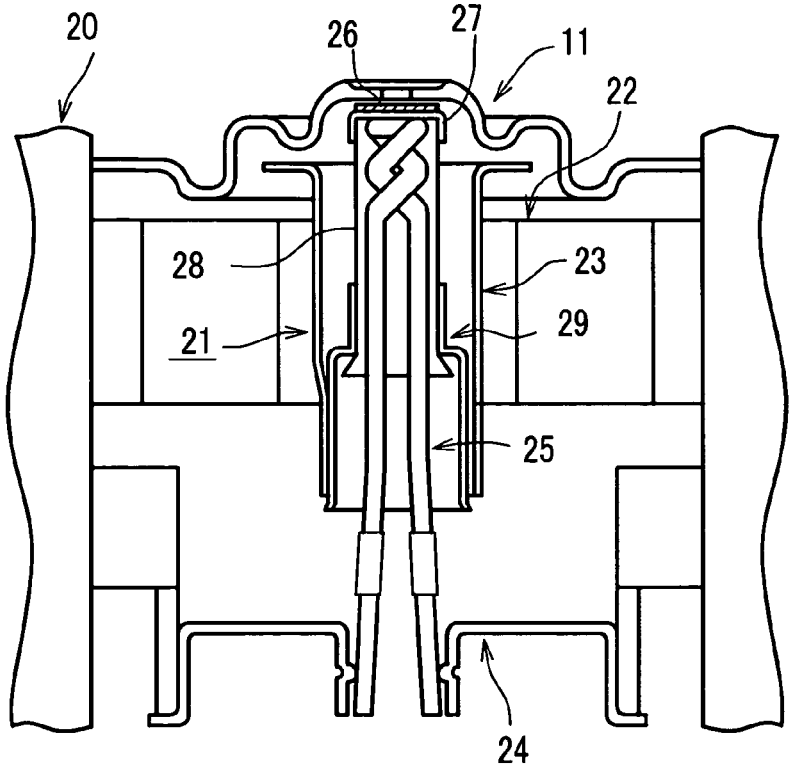
FIG. 5 (Prior Art)
FIG. 5 is a cross-sectional view of an essential part for explaining the constitution of the indirectly heated cathode structure.

In FIG. 4, numeral 34 indicates a heater leg portion formed of tungsten wire having a triplicate winding structure, numeral 35 indicates a heat generating portion (also referred to as "a heater main portion") having a single coil winding with a winding pitch coarser than a winding pitch of the heater leg portion 34, numeral 36 indicates a surface blackening treatment portion using alumina and tungsten fine powder, numeral 37 indicates an alumina coating portion, numeral 38 indicates an alumina non-coating portion which is a leg portion constituting an open end of the heating heater 45 shown in FIG. 3 and is welded to a heater support. The alumina non-coating portion 38 is welded and fixed to a heater support 24 shown in FIG. 5. Here, the surface blackening treatment portion 36 and the alumina coating portion 37 are collectively referred to as a covering portion of an insulation film.

To explain the indirectly heated cathode structure using specific numerical values, the heater 45 uses a tungsten wire having a diameter of approximately 25.7 μm (weight of tungsten wire being 2 mg (MG) per 200 mm). The heat generating portion 35 is formed in a region extending from a distal end (an uppermost portion in FIG. 4) by approximately 3 mm and a pitch of coil winding is 0.8 turn/mm and the number of coil winding layers is 1 (that is, a single layer). Further, on the coil winding layer of the heat generating portion 35, a molybdenum wire having a diameter of approximately 0.07 μm is wound with approximately 300 turns of coil winding at a pitch of 17 turns/mm. Further, the leg portion 34 is formed in a triplicate coil winding structure at a coil winding pitch of 15 turns/mm in a region which is contiguous with the tungsten wire of the heat generating portion 35 and extends to a position while leaving 7 mm of a portion where the triplicate coil winding structure is not adopted. That is, the leg portion 34 adopts the multiplex coil winding structure in which the coil winding pitch of the leg portion 34 is coarser than the coil winding pitch of the heat generating portion 35 and the number of coil winding layers is 3.

To explain the manner of forming the heating heater 45, first of all, the heat generating portion 35 of the heating heater 45 is subjected to the second shaping using a mandrel having a diameter of approximately 0.38 mm thus forming the duplicate spiral structure. Next, alumina is applied to the portions except for the heater leg portions 38 by electrodepositing, alumina containing tungsten fine powder is applied to an upper layer of the alumina layer, and the surface of the heater body is blackened. The blackened heater body is sintered in a hydrogen atmosphere at a temperature of approximately 1600° C. and, thereafter, the molybdenum wire which is wound around the heat generating portion 35 as a coil is preliminarily dissolved using acid whereby the heating heater 45 having the surface thereof subjected to the blacking treatment is manufactured.

Next, the heating heater 45 having such a structure and the indirectly heated cathode structure 21 are incorporated into the electronic gun, the sealing and evacuation treatment are applied to the cathode ray tube and, thereafter, a cathode temperature, the power consumption and the various electrical properties are evaluated. The cathode ray tube can obtain the normal cathode temperature (approximately 1000K on an electron irradiating surface) under an operational condition in which the heater rating is 6.3V–75 mA (power consumption 0.47 W).

Here, tungsten wires respectively having a wire diameter of 29.3 μm (2.6 MG) and a wire diameter of 21.4 μm (1.4 MG) are selected as tungsten wires around the tungsten wire having the wire diameter of 25.7 μm (2 MG). These tungsten wires are manufactured in the same manner as the above-mentioned method and their electrical properties are evaluated. As a result, with respect to the tungsten wire having the diameter of 29.3 μm (2.6 MG), it is found that the power consumption is 0.59 W and hence is large at the heater rating of 6.3V–93 mA. Further, with respect to the tungsten wire having the diameter of 21.4 μm (1.4 MG), it is found that this tungsten wire exhibits the poor workability in the manufacturing of the heater suitable for the cathode ray tube having the rating of 6.3V and the heater disconnection occurrence rate is high. Accordingly, it has been proved by the repeated experiment carried out by inventors of the present invention that with the use of the tungsten wire having the wire diameter which falls in a range of 22 μm (weight being 1.5 mg per 200 mm) to 29 μm (weight being 2.5 mg per 200 mm), the heater power consumption per one heating heater 45 becomes 0.5 W or less at the heater rating in a range of 6.0 to 6.6V.

Further, by adopting the indirectly heated cathode structure 21 having the above-mentioned constitution and the heater 45 having the wire diameter of the tungsten wire of equal to or less than 29 μm, the thermal efficiency is enhanced whereby the reduction of the power consumption of the indirectly heated cathode structure 21, particularly the reduction of the power consumption of the heating heater system and the cathode system can be achieved. Further, although stray electrons are generated due to the presence of barium in the thermal electron emitting material layer adhered to the opening of the control electrode 11 shown in FIG. 5, since the temperature of the control electrode 11 is low, it has been confirmed that the stray electrons are hardly generated. Further, with respect to the drift characteristics, although a cut-off voltage changes due to the deformation of shape of the indirectly heated cathode structure 21 and the control electrode 11 and the brightness of the screen, particularly the black level of the background changes, it has been confirmed that the occurrence of this phenomenon is also decreased.

As has been explained heretofore, according to the cathode ray tube of the present invention, the indirectly heated cathode structure which constitutes the electron beam generating portion of the electron gun includes the sleeve having the base metal for holding the thermal electron emitting material layer at one end portion thereof and housing the heater in the inside thereof, and the cathode disc having the large-diameter portion and the small-diameter portion which has the large-diameter portion at the position close to the main heat generating portion of the heater and has the small-diameter portion at the leg portion of the heater and is mounted by way of the difference-diameter support which supports the sleeve, wherein the outer surface of another end portion of the sleeve and the inner surface of the small-diameter portion of the support are fixed to each other, and the outer surface of the large-diameter portion of the support and the inner surface of the small-diameter portion of the cathode disc are fixed to each other, whereby the heat conduction distance from the outer wall surface of the sleeve to the end portion of the large-diameter portion of the cathode disc by way of the support is elongated. Accordingly, it is possible to obtain the extremely excellent advantageous effects including the advantageous effect that leaking of heat from the sleeve can be reduced and hence, the thermal efficiency is enhanced whereby the lowering of the power consumption of the indirectly heated cathode structure can be realized.

Further, according to the cathode ray tube of the present invention, by setting the plate thickness of the sleeve housing the heating heater in the inside of the indirectly heated cathode structure to 20 μm or less, it is possible to further reduce the leaking of heat through the sleeve and hence, the thermal efficiency is further enhanced and it is possible to obtain the extremely excellent advantageous effects including the realization of further lowering of the power consumption of the indirectly heated cathode structure.

Further, according to the cathode ray tube of the present invention, the indirectly heated cathode structure uses the tungsten wire having the wire diameter of 22 μm to 29 μm or less as the heater, and the leg portion of the heater is formed in the multiplex winding structure having the number of winding larger than the number of winding of the heat generating portion of the heater and hence, the thermal efficiency of the heat generating portion of the heater can be enhanced whereby the lowering of the power consumption of the indirectly heated cathode structure can be realized. Further, along with the lowering of the power consumption, it is possible to obtain other extremely excellent advantageous effects such as the improvement of the various electrical characteristics such that the occurrence of the drift attributed to the thermal deformation of the electrodes which constitute the electron gun can be eliminated, and the temperature of the electrodes which constitute the electron gun is lowered so that the occurrence of the stray electrons can be prevented.

The invention claimed is:

1. A cathode ray tube including a vacuum envelope comprising:

a panel portion having a phosphor screen to which phosphor is applied on an inner surface thereof;

a neck portion housing an electron gun which is constituted of an electron beam generating portion which includes an indirectly heated cathode structure, a control electrode and an acceleration electrode, a focusing electrode and an anode electrode and has a main lens portion which focuses and accelerates electron beams; and a funnel portion connecting the panel portion and the neck portion, wherein the indirectly heated cathode structure includes a base metal having a electron emitting material layer, a cylindrical sleeve holding the base metal at one end portion thereof and housing a heating heater in the inside thereof, a cylindrical support having a large-diameter portion at a heater-main-portion side of the heater and a small-diameter portion at a leg-portion-side of the heater and supporting the sleeve, and a cylindrical cathode disc having a large-diameter portion at the leg-portion-side of the heater and having a small-diameter portion at the heater-main-portion side of the heater, wherein an outer surface of another end portion of the sleeve and an inner surface of the small-diameter portion of the support are fixed to each other, and an outer surface of the large-diameter portion of the support and an inner surface of the small-diameter portion of the cathode disc are fixed to each other.

2. A cathode ray tube according to claim 1, wherein a plate thickness of the sleeve is set to a value equal to or more than 15 μm and equal to or less than 20 μm.

3. A cathode ray tube according to claim 1, wherein the heater uses a tungsten wire having a wire diameter which falls within a range of 22 μm to 29 μm, and the number of multiplex winding of a leg portion of the heating heater is larger than the number of multiplex winding of the heater main portion of the heater.

* * * * *